US010907429B2

(12) United States Patent
Xu et al.

(10) Patent No.: US 10,907,429 B2
(45) Date of Patent: Feb. 2, 2021

(54) PLUG FORMED FROM A DISINTEGRATE ON DEMAND (DOD) MATERIAL

(71) Applicants: YingQing Xu, Tomball, TX (US); Beau Wright, Tomball, TX (US); Zhiyue Xu, Cypress, TX (US); James Doane, Friendswood, TX (US); Mike Johnson, Katy, TX (US); Jack Farmer, Houston, TX (US); David Ruddock, Pearland, TX (US)

(72) Inventors: YingQing Xu, Tomball, TX (US); Beau Wright, Tomball, TX (US); Zhiyue Xu, Cypress, TX (US); James Doane, Friendswood, TX (US); Mike Johnson, Katy, TX (US); Jack Farmer, Houston, TX (US); David Ruddock, Pearland, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 121 days.

(21) Appl. No.: 15/784,882

(22) Filed: Oct. 16, 2017

(65) Prior Publication Data

US 2019/0112887 A1 Apr. 18, 2019

(51) Int. Cl.

| | |
|---|---|
| ***E21B 29/02*** | (2006.01) |
| ***E21B 33/12*** | (2006.01) |
| *E21B 29/00* | (2006.01) |

(52) U.S. Cl.

CPC ..... *E21B 29/02* (2013.01); *E21B 33/1208* (2013.01); *E21B 29/00* (2013.01); *E21B 33/12* (2013.01)

(58) Field of Classification Search

CPC ..... E21B 29/02; E21B 29/00; E21B 33/12

See application file for complete search history.

(56) References Cited

U.S. PATENT DOCUMENTS

| | | | | |
|---|---|---|---|---|
| 2003/0168214 | A1 | 9/2003 | Sollesnes | |
| 2004/0221993 | A1 | 11/2004 | Patterson et al. | |
| 2009/0308620 | A1 | 12/2009 | Tilghman | |
| 2010/0101803 | A1 | 4/2010 | Clayton et al. | |
| 2011/0000663 | A1* | 1/2011 | Brandsdal | E21B 33/12 166/178 |
| 2016/0130906 | A1* | 5/2016 | Garvey | E21B 34/063 166/376 |
| 2018/0230770 | A1* | 8/2018 | Oag | E21B 33/12 |
| 2019/0032435 | A1* | 1/2019 | Kochanek | E21B 29/02 |

FOREIGN PATENT DOCUMENTS

| | | | |
|---|---|---|---|
| EP | 0122012 | A2 | 10/1984 |

OTHER PUBLICATIONS

Notification of Transmittal of the International Search Report and the Written Opinion of the International Searching Authority; Application No. PCT/US2018/050814; dated Jan. 3, 2019; 11 pages.

* cited by examiner

*Primary Examiner* — Tara Schimpf
(74) *Attorney, Agent, or Firm* — Cantor Colburn LLP

(57) ABSTRACT

A tubular includes an outer surface and an inner surface defining a passage. A plug is arranged in the tubular blocking the passage. The plug is formed from a disintegrating on demand (DOD) material. An ignition device is coupled to the plug. An excitation mechanism is selectively operatively associated with the ignition device. The excitation mechanism selectively activates the ignition device to break apart the plug.

8 Claims, 3 Drawing Sheets

PLUG FORMED FROM A DISINTEGRATE ON DEMAND (DOD) MATERIAL

BACKGROUND

In the resource recovery and exploration industry, including wellbore formation, completions, production, treatment, and the like, plugs are often employed in a tubular during various borehole operations. Plugs are often used to enable pressuring up of selected segments of a tubular string. The pressuring up may be employed to activate either directly, or indirectly, one or more devices arranged in the tubular string. Plugs may also be employed for other purposes such as guiding fluids to a particular zone, completions operations and the like.

Once the need for the plug is over, it is desirable to re-open the tubular. Current plugs may take the form of balls or other devices. Balls may be pressured through a ball seat and allowed to fall to a toe of the borehole. In other cases, the ball may be formed from a degradable material. Other type of plugs in various shapes are also employed. Plugs may be formed from a degradable material and allowed to dissolve over time. Unfortunately, waiting for a plug to dissolve may waste valuable production time. Accordingly, the art would be receptive to plugs that may be readily removed without the need for a prolonged waiting period.

SUMMARY

Disclosed is a tubular including an outer surface and an inner surface defining a passage. A plug is arranged in the tubular blocking the passage. The plug is formed from a disintegrating on demand (DOD) material. An ignition device is coupled to the plug. An excitation mechanism is selectively operatively associated with the ignition device. The excitation mechanism selectively activates the ignition device to break apart the plug.

Also disclosed is a resource exploration and recovery system including a first system, and a second system operatively connected to the first system. The second system includes at least one tubular having an outer surface and an inner surface defining a passage. A plug is arranged in the tubular completely blocking the passage. The plug is formed from a disintegrating on demand (DOD) material. An ignition device is coupled to the plug. An excitation mechanism is selectively operatively associated with the ignition device. The excitation mechanism selectively activates the ignition device to break apart the plug.

Further disclosed is a method of removing a plug formed from a disintegrate on demand (DOD) secured in a passage of a tubular including delivering an excitation force to an ignition device operatively associated with the plug formed from DOD material, activating the ignition device with the excitation force, and breaking apart the plug with the ignition device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
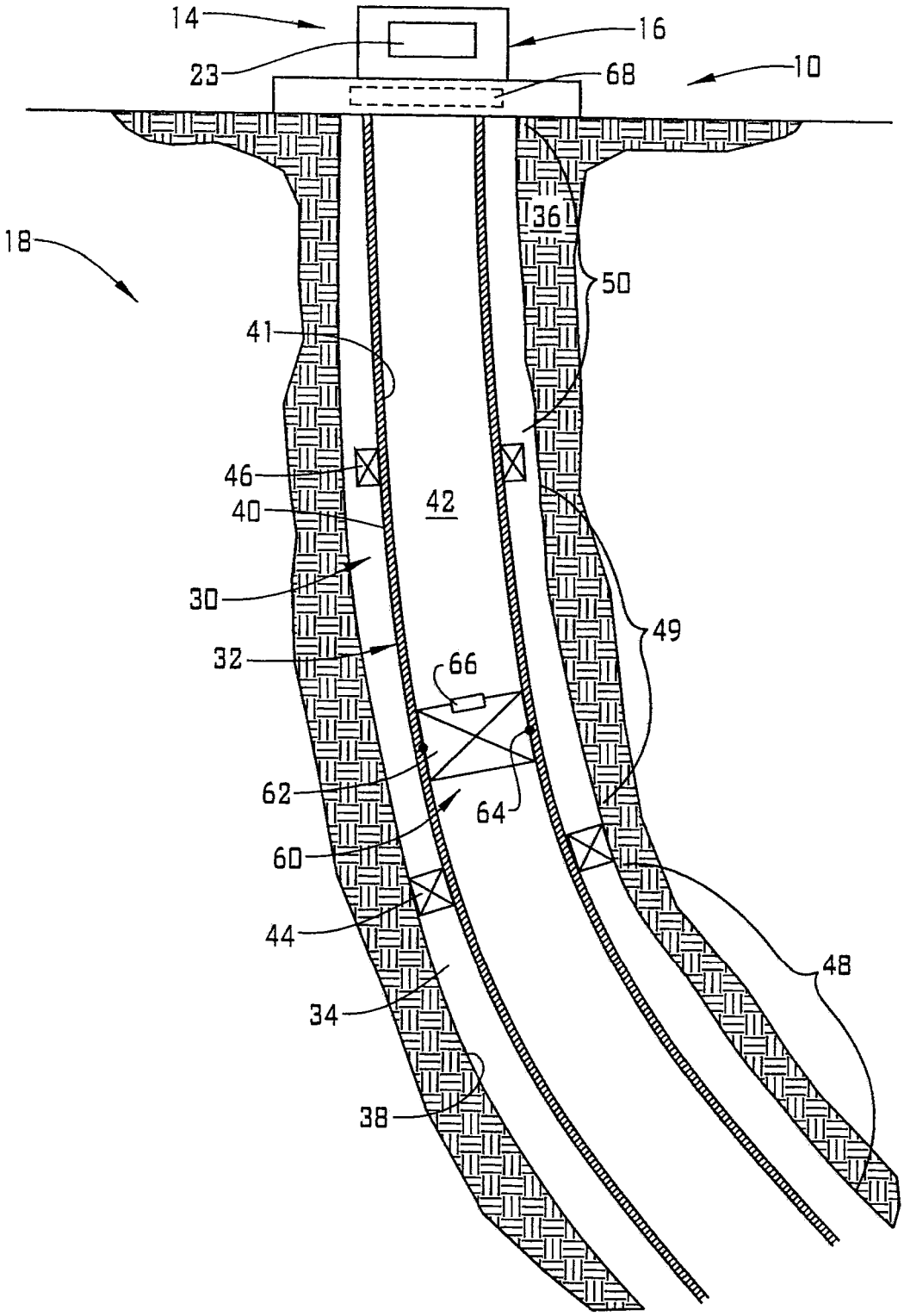
FIG. 1 depicts a resource recovery and exploration system including a plug formed from a disintegrate on demand (DOD) material, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like.

Second system 18 may include a tubular string 30 formed from a plurality of tubulars, one of which is indicated at 32 that is extended into a wellbore 34 formed in formation 36. Wellbore 34 includes an annular wall 38 which may be defined by a surface of formation 36, or a casing tubular (not shown). Tubular 32 includes an outer surface 40 and an inner surface 41 that defines a passage 42. A first expandable member which may take the form of a first packer 44 is arranged on outer surface 40 of tubular 32. First packer 44 may be selectively expanded into contact with annular wall 38. A second expandable device which may take the form of a second packer 46 is arranged on outer surface 40 of tubular 32 spaced from first packer 44 along tubular string 30. First and second packers 44 and 46 may collectively define a first zone 48, a second zone 49 and a third zone 50 along tubular string 30. The number, size and location of each zone 48-50 may vary.

In accordance with an aspect of an exemplary embodiment, a plug 60 is arranged in tubular 32 between first packer 44 and second packer 46. It should be understood that the location of plug 60 may vary. Plug 60 is formed from a disintegrating on demand (DOD) material 62 that selectively breaks apart upon being exposed to an ignition source, as will be detailed herein. Plug 60 may include a seal 64 that engages inner surface 41 of tubular 32. In this manner, plug 60 may prevent fluid from passing upwardly from first zone 48 or downwardly from second zone 49.

Figure 2:
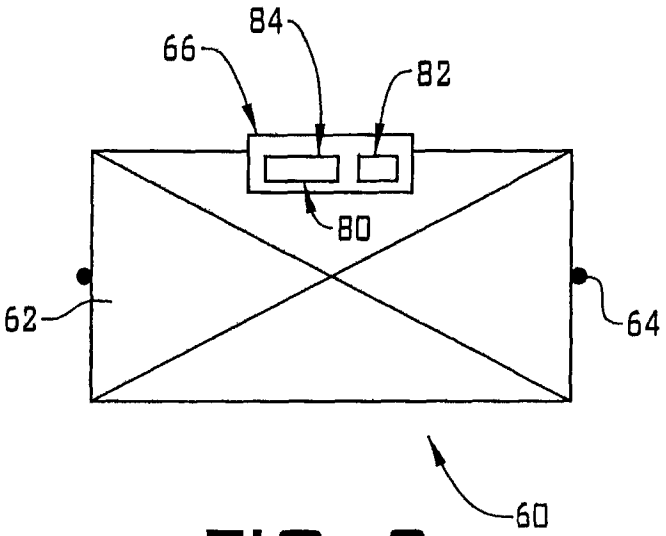
FIG. 2 depicts the plug of FIG. 1, in accordance with an aspect of an exemplary embodiment.

In accordance with an exemplary aspect, an ignition device 66 abuts plug 60. In the exemplary embodiment shown, ignition device 66 may be partially embedded into DOD material 62. An excitation device 68, which may be arranged at first system 14, may be selectively employed to activate ignition device 66 to break apart and remove plug 60 from passage 42. Referencing FIG. 2, and with continued reference to FIG. 1, ignition device 66 may include an activation member 80 and a power supply 82. Activation member 80 could take the form of a sensor 84.

Sensor 82 may be configured to detect a signal from excitation device 68. Upon receipt of a proper signal, sensor 82 may connect power supply 84 to an ignition source (not separately labeled) and activate ignition device 66. The signal may be in the form of one or more selected pressure pulses introduced into passage 42 or electrical signals passed along tubular string 30 or through formation 36. The signal may cause ignition device 66 to ignite, causing a detonation of DOD material 62 that breaks apart plug 60.

Figure 3:
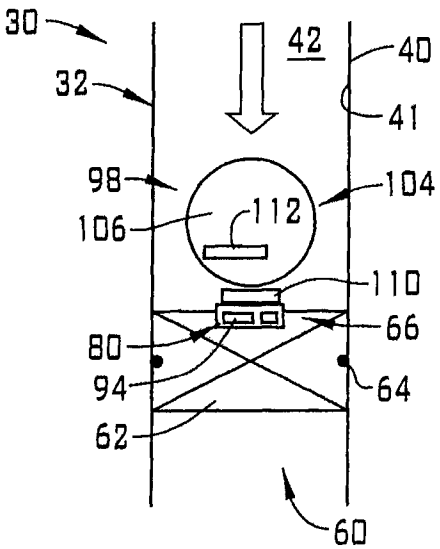
FIG. 3 depicts a plug formed from a DOD material arranged in a tubular, in accordance with another aspect of an exemplary embodiment.

Reference will now follow to FIG. 3, wherein like reference numbers represent corresponding parts in the respective views. In the exemplary aspect shown, activation member 80 may take the form of a switch 94. Switch 94 may be moved from a non-conducting configuration to a conducting configuration by an excitation mechanism 98. In an example, excitation mechanism 98 may take the form of a mechanical element 104 such as a dropball 106. It is to be understood that mechanical element 104 may take on various forms. Dropball 106 may include an activator element 110 and a power supply 112. Alternatively, ignition device 66 may include a power supply. Activator element 110 may take the form of a magnet and switch 94 may take the form of a magnetically activated toggle. Mechanical element 104, upon contacting or nearing plug 60 may trigger ignition device 66 to generate a detonation. The detonation causes plug 60 to break apart so as to open passage 42. Of course, it should be appreciated, that mechanical element 104 could activate activation member 80 through simple contact.

Figure 4:
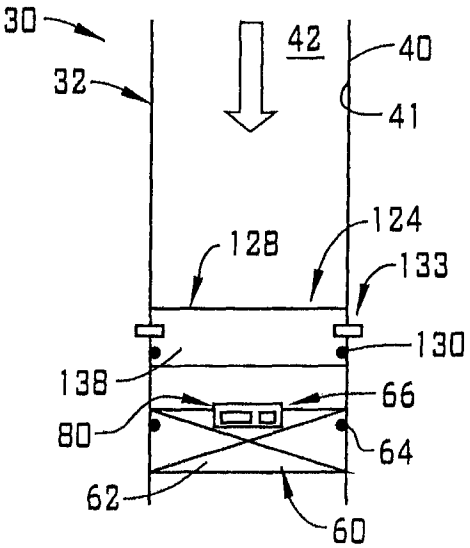
FIG. 4 depicts a plug formed from a DOD material arranged in a tubular, in accordance with yet another aspect of an exemplary embodiment.

Reference will now follow to FIG. 4, wherein like reference numbers represent corresponding parts in the respective views, in describing an excitation mechanism 124 in accordance with another aspect of an exemplary embodiment. Excitation mechanism 124 may take the form of another plug 128 arranged in passage 42 upwardly relative to plug 60. Another plug 128 may include a seal 130 that engages inner surface 41 of tubular 32. Another plug 128 may be affixed to tubular 32 through one or more shear elements such as indicated at 133 and 134. A pressure may be applied to another plug 128 causing shear elements 133, 134 to fail. Another plug 128 may then contact ignition device 66, causing activation member 80 to trigger a detonation that breaks apart plug 60. In an embodiment, another plug 128 may also be formed from a DOD material 138. As such, the detonation would not only break apart plug 60, but also break apart another plug 128 clearing passage 42.

Figure 6:
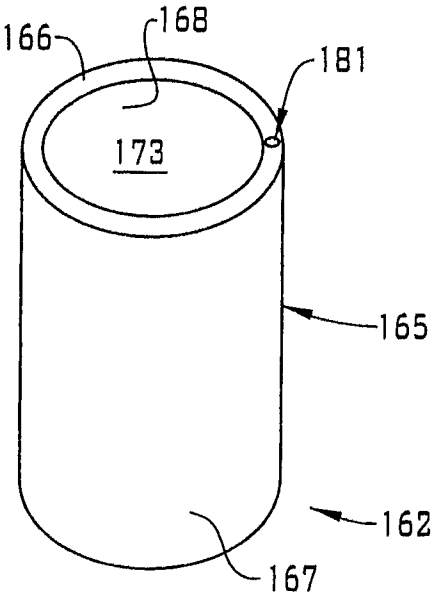
FIG. 6 depicts a tubular including a passage, in accordance with an aspect of an exemplary embodiment.
Figure 5:
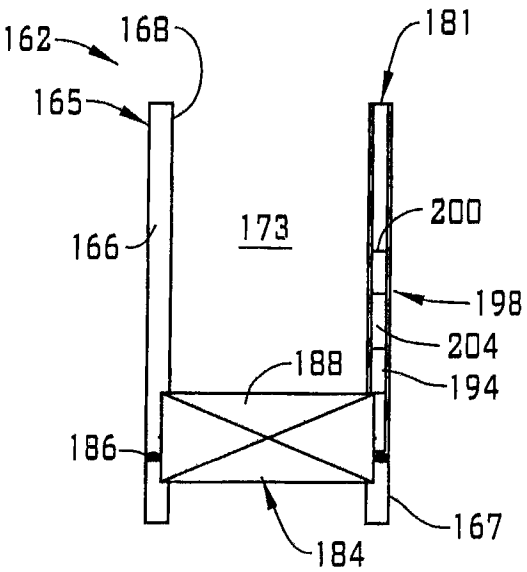
FIG. 5 depicts a plug formed from a DOD material arranged in a tubular, in accordance with still yet another aspect of an exemplary embodiment.

Reference will follow to FIGS. 5 and 6 in describing a system of tubulars 162 in accordance with another aspect of an exemplary embodiment. System of tubulars 162 includes a tubular 165 having a wall 166 defined by an outer surface 167 and an inner surface 168 that defines a first passage 173. A second passage 181 is formed in wall 166 radially outwardly of first passage 173. Second passage 181 extends longitudinally along tubular 165. Second passage 181 may take the form of a bore (not separately labeled) formed in wall 166 radially outwardly of first passage 173 as shown in FIG. 6. Of course, it should be appreciated that second passage 181 could take on a variety of forms such as an annular space or gap between two tubulars. A plug 184 is arranged in first passage 173. A portion of plug 184 (not separately labeled) may be exposed at second passage 181. Plug 184 may include a seal 186 that engages inner surface 168. Plug 184 is formed from a DOD material 188.

In accordance with an exemplary aspect, an ignition device 194 may be arranged in second passage 181. Ignition device 194 includes an activation mechanism 198 that may take the form of a sensor 200, and a power source 204. In this arrangement, an excitation force, such as a pressure signal, electrical signal or the like is passed from first system 14 to ignition device 194. Upon receipt of a selected signal, ignition device 194 activates, causing a detonation that ignites and breaks apart plug 184.

Figure 7:
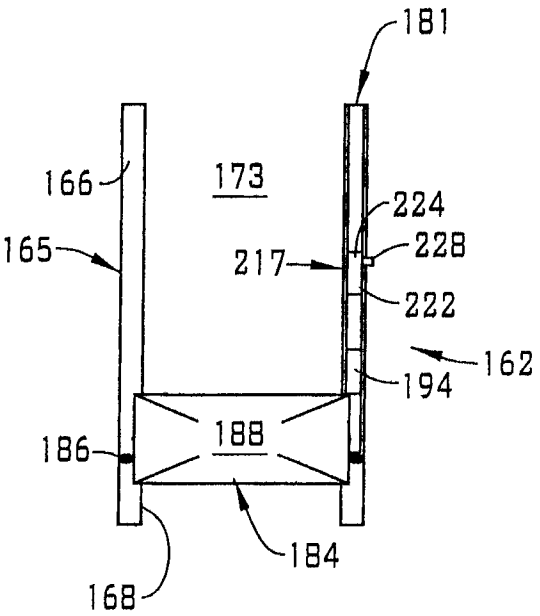
FIG. 7 depicts a plug formed from a DOD material arranged in the tubular of FIG. 6, in accordance with yet still another aspect of an exemplary embodiment.

Reference will now follow to FIG. 7, wherein like reference numbers represent corresponding parts in the respective views, in describing an excitation member 217 in accordance with another aspect of an exemplary embodiment. Excitation member 217 takes the form of a mechanical element 222 that may have a shape of a rod, a sleeve or the like 224, arranged in second passage 181. Mechanical element 222 may be maintained in place upwardly of ignition device 194 by a shear element 228. In this manner, a signal, such as an application of pressure, may cause mechanical element 222 to shift, break shear element 228 and travel toward ignition device 194. Mechanical element 222 causes ignition device 194 to detonate and break apart plug 184.

It should be understood that the exemplary embodiments describe a plug formed from a disintegrate on demand (DOD) material that may be ignited and broken apart on demand. That is, one a need for the plug has passed, a signal may be send to an ignition device. The ignition device detonates the plug opening a passageway in a short time period. It should also be understood that the particular type of ignition device may vary, location of power for the ignition device may vary, and excitation of the ignition device may vary.

Set forth below are some embodiments of the foregoing disclosure:

Embodiment 1

A tubular comprising an outer surface and an inner surface defining a passage, a plug arranged in the tubular blocking the passage, the plug being formed from a disintegrating on demand (DOD) material, an ignition device coupled to the plug, and an excitation mechanism selectively operatively associated with the ignition device, the excitation mechanism selectively activating the ignition device to break apart the plug.

Embodiment 2

The tubular according to any prior embodiment, wherein the ignition device directly abuts the plug.

Embodiment 3

The tubular according to any prior embodiment, wherein the ignition device is at least partially embedded in the plug.

Embodiment 4

The tubular according to any prior embodiment, wherein the excitation mechanism comprises a pressure delivery system operable to deliver a pressure pulse into the passage to activate the ignition device and break up the plug.

Embodiment 5

The tubular according to any prior embodiment, wherein the excitation mechanism comprises a mechanical element operable to deliver an impact to the ignition device, the impact causing the ignition device to activate and break up the plug.

Embodiment 6

The tubular according to any prior embodiment, wherein the mechanical element is formed from a DOD material, wherein activation of the ignition device causes both the plug and the mechanical element to break apart.

Embodiment 7

The tubular according to any prior embodiment, wherein the mechanical element comprises another plug arranged in the passage.

Embodiment 8

The tubular according to any prior embodiment, wherein the mechanical element comprises a rod.

Embodiment 9

The tubular according to any prior embodiment, wherein the ignition device includes at least one of a sensor and a power source.

Embodiment 10

The tubular according to any prior embodiment, wherein the sensor comprises a switch.

Embodiment 11

The tubular according to any prior embodiment, further comprising: another passage arranged radially outwardly of the passage, the ignition device being arranged in the another passage.

Embodiment 12

A resource exploration and recovery system comprising a first system, a second system operatively connected to the first system, the second system including at least one tubular comprising an outer surface and an inner surface defining a passage, a plug arranged in the tubular completely blocking the passage, the plug being formed from a disintegrating on demand (DOD) material, an ignition device coupled to the plug, and an excitation mechanism selectively operatively associated with the ignition device, the excitation mechanism selectively activating the ignition device to break apart the plug.

Embodiment 13

The resource exploration and recovery system according to any prior embodiment, wherein the ignition device directly abuts the plug.

Embodiment 14

The resource exploration and recovery system according to any prior embodiment, wherein the excitation mechanism comprises a pressure delivery system operable to deliver a pressure pulse into the passage to activate the ignition device and break up the plug.

Embodiment 15

The resource exploration and recovery system according to any prior embodiment, wherein the excitation mechanism comprises a mechanical element operable to deliver an impact to the ignition device, the impact causing the ignition device to activate and break up the plug.

Embodiment 16

The resource exploration and recovery system according to any prior embodiment, wherein the mechanical element is formed from a DOD material, wherein activation of the ignition device causes both the plug and the mechanical element to break apart.

Embodiment 17

The resource exploration and recovery system according to any prior embodiment, wherein the ignition device includes at least one of a sensor and a power source.

Embodiment 18

The resource exploration and recovery system according to any prior embodiment, further comprising another passage arranged radially outwardly of the passage, the ignition device being arranged in the another passage.

Embodiment 19

A method of removing a plug formed from a disintegrate on demand (DOD) secured in a passage of a tubular comprising delivering an excitation force to an ignition device operatively associated with the plug formed from DOD material, activating the ignition device with the excitation force, and breaking apart the plug with the ignition device.

Embodiment 20

The method of any prior embodiment, wherein breaking apart the plug includes exploding the plug with the ignition device.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A tubular comprising:

an outer surface and an inner surface defining a passage;

a plug arranged in the tubular blocking the passage, the plug having an annular seal that engages the inner surface and being formed from a disintegrating on demand (DOD) material;

an ignition device coupled to the plug, the ignition device comprising an activation member having a sensor and a power source, the ignition device being embedded in the plug and being selectively operable to deliver a detonation force to the plug; and an excitation mechanism selectively operatively associated with the ignition device, the excitation mechanism comprising a pressure delivery system operable to deliver one or more pressure pulses into the passage to selectively detonate the ignition device creating the detonation force that breaks apart the plug.

2. The tubular according to claim 1, wherein the ignition device directly abuts the plug.

3. The tubular according to claim 2, wherein the ignition device is at least partially embedded in the plug.

4. The tubular according to claim 1, wherein the sensor comprises a switch.

5. A resource exploration and recovery system comprising:

a first system;

a second system operatively connected to the first system, the second system including at least one tubular comprising:

an outer surface and an inner surface defining a passage;

a plug arranged in the tubular completely blocking the passage, the plug having an annular seal that engages the inner surface and being formed from a disintegrating on demand (DOD) material;

an ignition device coupled to the plug, the ignition device comprising an activation member having a sensor and a power source, the ignition device being embedded in the plug and being selectively operable to deliver a detonation force to the plug; and an excitation mechanism selectively operatively associated with the ignition device, the excitation mechanism comprising a pressure delivery system operable to deliver one or more pressure pulses into the passage to selectively detonate the ignition device creating the detonation force that breaks apart the plug.

6. The resource exploration and recovery system according to claim 5, wherein the ignition device directly abuts the plug.

7. A method of removing a plug having an annular seal formed from a disintegrate on demand (DOD) material secured in a passage of a tubular, the annular seal engaging an inner surface of the passage, the method comprising:

delivering an excitation force comprising a pressure pulse into the passage;

receiving the pressure pulse at an ignition device comprising an activation member including a sensor and a power source embedded in the plug;

triggering the power source based on the pressure pulse;

igniting the ignition device formed from DOD material with the power source;

detonating the ignition device with the pressure pulse to generate a detonation force; and breaking apart the plug with the detonation force generated by the ignition device.

8. The method of claim 7, wherein breaking apart the plug includes exploding the plug with the ignition device.

* * * * *